US006017208A

United States Patent [19]

Schultz

[11] Patent Number: 6,017,208

[45] Date of Patent: Jan. 25, 2000

[54] CHAIN DRIVEN ROLLER SYSTEM FOR USE IN CONCRETE PIPE MANUFACTURING

[75] Inventor: Frederick B. Schultz, Green Bay, Wis.

[73] Assignee: Concrete Technology Integrators, Inc., Green Bay, Wis.

[21] Appl. No.: 08/864,487

[22] Filed: May 28, 1997

[51] Int. Cl.[7] ..... B28B 21/24

[52] U.S. Cl. ..... 425/262; 425/427

[58] Field of Search ..... 425/262, 427, 425/457

[56] References Cited

U.S. PATENT DOCUMENTS

| | | | |
|---|---|---|---|
| 1,895,740 | 1/1933 | Ukropina | 425/262 |
| 3,096,556 | 7/1963 | Woods . | |
| 3,276,091 | 10/1966 | Pausch . | |
| 3,632,270 | 1/1972 | Baker et al. | 425/262 |
| 4,340,553 | 7/1982 | Fosse | 264/40.7 |
| 4,505,658 | 3/1985 | Müller | 425/117 |
| 4,690,631 | 9/1987 | Haddy | 425/262 |
| 4,957,424 | 9/1990 | Mitchell et al. | 425/262 |
| 5,456,590 | 10/1995 | Volmari | 425/262 |
| 5,616,351 | 4/1997 | Wensauer | 425/262 |

*Primary Examiner*—James P. Mackey

*Attorney, Agent, or Firm*—Andrus, Sceales, Starke & Sawall

[57] ABSTRACT

A concrete pipe manufacturing machine movable in a mold for receiving a concrete mixture to form a tubular concrete wall includes a troweling cylinder assembly having a head plate. A vertically movable and rotatable drive shaft is fixed to the head plate for moving the troweling cylinder assembly in a vertical direction and in one rotational direction. A series of roller assemblies are rotatably mounted on the head plate and are adapted to be rotated by frictional contact with the concrete mixture in a direction counter to the one rotational direction of the drive shaft. A drive arrangement interconnects and collectively drives the roller assemblies together for preventing jamming of the roller assemblies due to material in the concrete mixture.

3 Claims, 2 Drawing Sheets

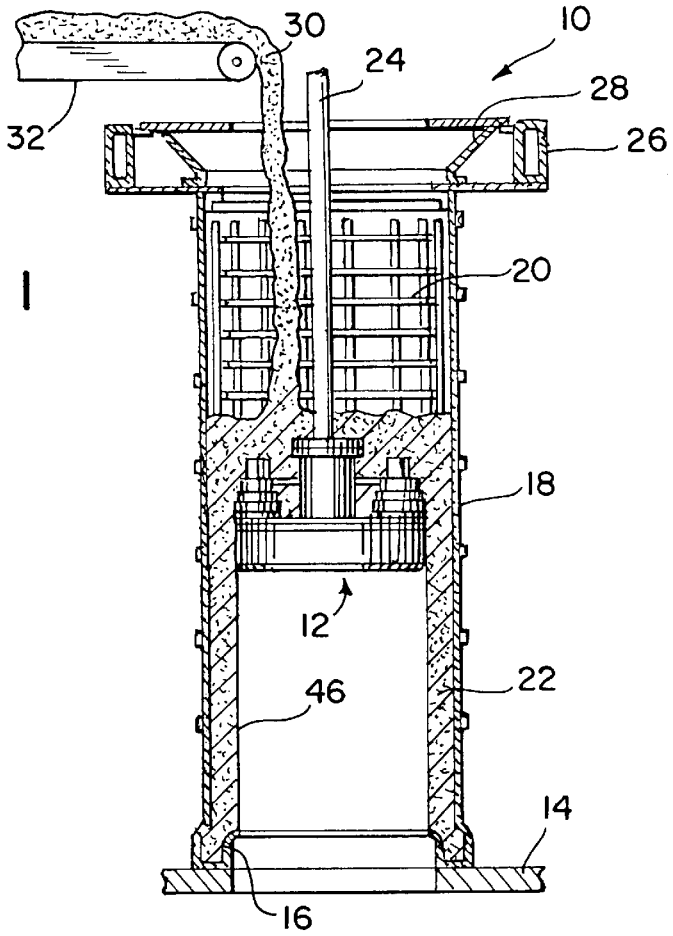
FIG. 1
FIG. 2
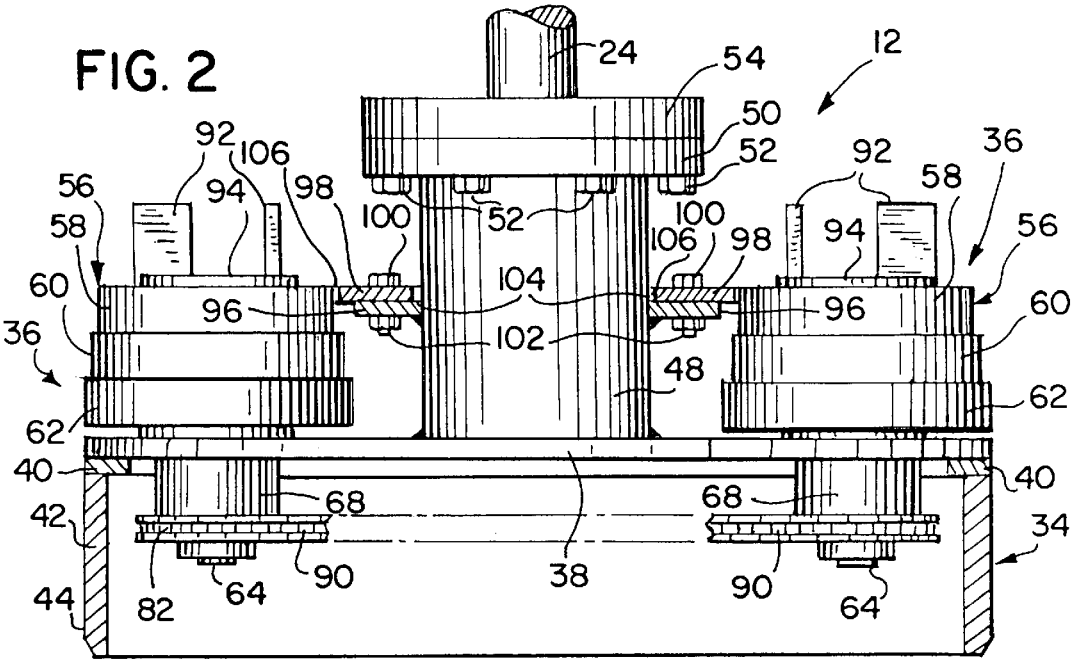

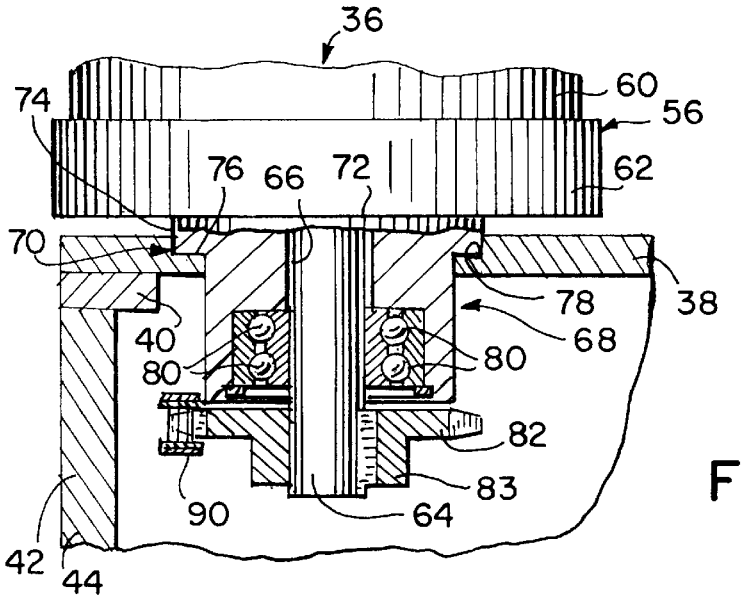
FIG. 3
FIG. 4
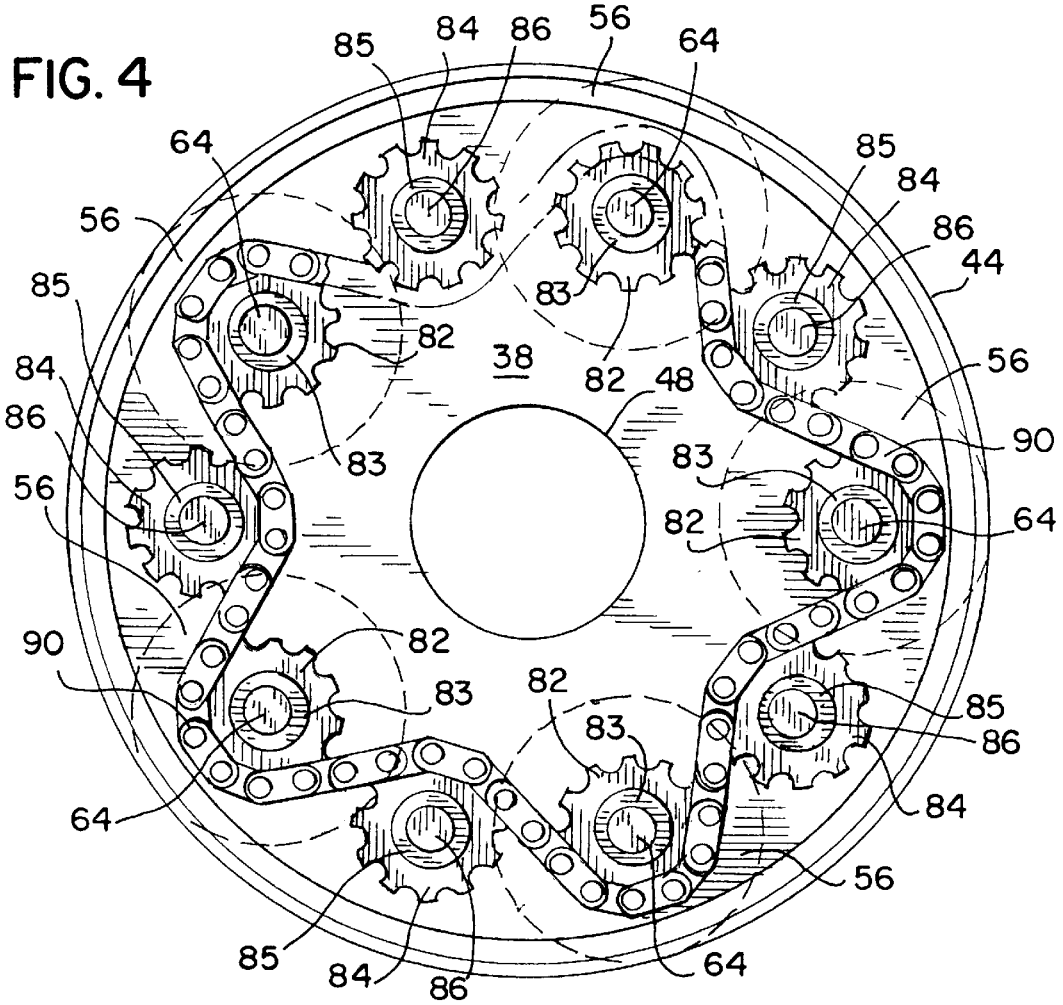

CHAIN DRIVEN ROLLER SYSTEM FOR USE IN CONCRETE PIPE MANUFACTURING

CROSS-REFERENCE TO RELATED APPLICATIONS

Not applicable.

STATEMENT REGARDING FEDERALLY SPONSORED RESEARCH OR DEVELOPMENT

Not applicable.

FIELD OF THE INVENTION

This invention relates broadly to an apparatus and method for forming cement, concrete or other aggregate pipes in molds, and, more particularly, pertains to a forming head device which is movable within the mold to distribute and compact a stream of aggregate material.

BACKGROUND AND SUMMARY OF THE INVENTION

It is conventional practice in dry casting of concrete pipe products to dispose a mold on the base of a concrete pipe machine that is provided with a vertically movable crosshead having a vertically driven shaft on the lower end of which a packer head is attached. The packer head typically includes a troweling cylinder which is rotated in one direction by the driven shaft, and a plurality of distributing rollers which are frictionally driven by engagement with the concrete in a direction opposite to that of the driven shaft on the troweling cylinder. With the packer head moved to its lowermost position so the top is at or below the level of a lower pallet, cement or concrete is fed to the interior of the mold. Then, as the crosshead is raised causing the packer head to be raised, the friction driven rollers pack the cement or concrete against the inner surface of the mold and the troweling cylinder is counter-rotated to finish the inner surface thereby forming the pipe. When the packer head reaches an upper pallet, the pipe is completed. The packer head is then withdrawn from the finished pipe and the form thus provided with a molded pipe is replaced by an empty form and the pipe molding process repeated. The self-supporting formed pipe is then demolded and stored to reach a sufficient set strength after an initial curing to enable handling of the pipe and removal from the pallet.

One of the problems in the manufacture of tubular concrete pipe by the packer head method is that foreign material or particles in the incoming concrete flow can become lodged between the troweling cylinder and one or more of the distributing rollers, thereby causing the rollers to stick or jam. When jamming of this nature occurs and one or more of the rollers does not rotate, the compaction of the concrete becomes uneven and the quality of the pipe formation suffers accordingly. It is therefore desirable to provide a packer head type device which prevents sticking or jamming of the rollers without adding complex structure and undue costs. It is also desirable to improve the quality of compaction without resorting to an externally driven source for driving the distributing rollers.

It is a broad object of the present invention to provide a concrete pipe manufacturing machine having a linkage arrangement for collectively driving the rollers so as to not only compact but to extrude concrete in a highly efficient manner.

It is a further object of the present invention to provide a concrete pipe manufacturing machine having a transmission arrangement coupling each of the rollers together to define a synchronous friction drive for equalizing the frictional forces applied to the rollers.

Yet a further object of the present invention is to provide a concrete pipe manufacturing machine employing chain driven roller assemblies for driving the rollers at the same speed.

Still a further object of the present invention is to provide a method of manufacturing concrete pipe using a stepped roller configuration and an arrangement coordinating the motion of the friction driven rollers.

Still another object of the present invention is to replace the known packer head device with an extruder head assembly which improves the quality of concrete pipe formation.

In one aspect of the invention, a concrete pipe manufacturing machine movable in a mold for receiving a concrete mixture to form a tubular concrete wall includes a troweling cylinder assembly having a head plate. A vertically movable and rotatable drive shaft is fixed to the head plate for moving the troweling cylinder assembly in a vertical direction and in one rotational direction. A series of roller assemblies are rotatably mounted on the head plate and adapted to be rotated by frictional contact with the concrete wall in a direction counter to the one rotational direction of the drive shaft. A linkage arrangement interconnects and collectively drives the roller assemblies together for preventing jamming of the roller assemblies due to material in the concrete mixture. Each of the roller assemblies includes a stepped roller including a first segment having a first diameter and a second segment having a diameter smaller than the first diameter. The roller has a support shaft rotatably supported in a bearing unit fixed to the head plate, the bearing unit spacing the roller above the head plate. The troweling cylinder has a cylindrical sidewall in vertical alignment with an outer edge of the roller first segment. The roller second segment is provided with at least one concrete-slinging vane. The roller assemblies are concentrically located on the head plate and spaced around the periphery thereof. The linkage arrangement includes a drive sprocket located on each of the roller assemblies, and a transmission band engaging each drive sprocket. The linkage arrangement further includes a set of idler sprockets interengaged by the transmission band, each of the idler sprockets lying between adjacent drive sprockets. In the preferred embodiment, the transmission band is a chain.

Another aspect of the invention relates to an improvement in a concrete pipe manufacturing machine having an extruder head assembly axially movable and rotatable about the longitudinal axis of a mold to which a concrete mixture is delivered, the extruder head assembly including a series of friction driven rollers engageable with the concrete mixture. The improvement relates to a transmission arrangement coupling each of the rollers and defining a synchronous friction drive for driving each of the rollers at the same speed and equalizing the frictional forces applied to the rollers. The transmission assembly is preferably non-motorized and includes a set of drive sprockets, each of the drive sprockets being fixed for rotation on one of the rollers. The transmission arrangement also includes a set of idler sprockets, each idler sprocket being rotatably mounted on the extruder head assembly and lying in the same horizontal plane as the drive sprockets. A chain links the drive sprockets and the idler sprockets together. The chain is wound about an outer peripheral portion of the drive sprockets and an inner peripheral portion of the idler sprockets.

In yet another aspect of the invention, a concrete pipe manufacturing machine movable in a mold for receiving a concrete mixture to form a tubular concrete wall has an extruder head assembly including a troweling cylinder assembly having a head plate and a cylindrical sidewall. A vertically movable and rotatable drive shaft is fixed to the head plate for moving the troweling cylinder assembly in a vertical direction and in one rotational direction. A series of roller assemblies are rotatably mounted on the head plate and adapted to be rotated by frictional contact with the concrete wall in a direction counter to the one rotational direction of the drive shaft. Each of the roller assemblies has a stepped roller provided with a first segment and a second segment, each of the segments having different diameters. Each roller assembly further includes a shaft supporting the roller, bearing structure secured to the head plate for rotatably supporting the roller and the shaft, and a drive sprocket fixed to the shaft. A series of idler sprockets are interposed between adjacent ones of the drive sprockets. A transmitting band interengages the drive sprockets and the idler sprockets for synchronously drivingly interconnecting the rollers so as to extrude the concrete with a high degree of compaction. The stepped roller preferably has a third segment having a diameter which is different than the diameters of the first segment and the second segment. Each of the rollers extends upwardly above the head plate, and the drive sprockets, the idler sprockets, and the transmitting band are preferably disposed beneath the head plate inside the cylindrical sidewall of the troweling cylinder assembly. The bearing unit has an annular collar fixed in an upper surface of the head plate, and the collar has a height which spaces each of the rollers for rotation above the head plate.

Still yet another aspect of the invention resides in a method for manufacturing concrete pipe in a mold receiving a concrete mixture to form a tubular concrete wall with a machine having a concrete packing assembly including a troweling cylinder assembly rotatable in one direction, and a series of friction driven rollers engageable with the concrete and rotatable in a direction opposite the direction of rotation of the troweling cylinder. The method includes the steps of positioning the concrete packing assembly in a lower portion of the mold; discharging the concrete mixture into the mold to provide a supply of material on top of the concrete packing assembly; moving the concrete packing assembly longitudinally in the mold from the bottom to the top; and extruding the concrete mixture in an annular space between the concrete packing assembly and the mold by rotating the rollers in the direction opposite the direction of rotation of the troweling cylinder during the longitudinal movement of the packing assembly. Each roller preferably has a stepped configuration and the rotation of the rollers causes an increasing degree of compaction on the concrete mixture as the packing head is raised. The method further involves packing the concrete mixture by rotating the troweling cylinder during the longitudinal movement thereof, and removing the concrete wall from the mold. The step of extruding the concrete mixture includes interconnecting and collectively driving the stepped rollers together to overcome any frictional resistance tending to jam any of the rollers.

Various other features, objects and advantages of the invention will be made apparent from the following description taken together with the drawings.

BRIEF DESCRIPTION OF THE SEVERAL VIEWS OF THE DRAWING

The drawings illustrate the best mode presently contemplated of carrying out the invention.

In the drawings:

FIG. 1 is a fragmentary view in partial cross-section of a concrete pipe manufacturing system equipped with an extruder head assembly embodying the present invention;

FIG. 2 is an enlarged fragmentary view in partial cross-section of the extruder head assembly shown in FIG. 1;

FIG. 3 is an enlarged, fragmentary view in partial cross-section showing the mounting of one of the rollers in the extruder head assembly shown in FIG. 2; and FIG. 4 is a bottom view of the extruder head assembly of FIG. 2.

DETAILED DESCRIPTION OF THE INVENTION

Referring to FIG. 1, there is shown a lower portion of a concrete pipe manufacturing system 10 provided with an extruder head assembly 12 embodying the present invention. Typically, system 10 comprises a turntable 14 adapted to support a pallet 16 and a cylindrical jacket or mold 18 having a cylindrical reinforcing cage 20 used in the formation of a tubular concrete pipe 22. An upper portion of the system 10 supports a downwardly directed drive shaft 24 to which the extruder head assembly 12 is mounted for simultaneous movement therewith. Drive shaft 24 is conventionally driven by a drive arrangement (not shown) mounted on the upper portion of the system 10 so as to provide rotational movement as well as vertical movement to the drive shaft 24 and the extruder head assembly 12. A top table 26 having a funneling mouth 28 is located above the upper end of jacket 18 for receiving a stream or flow of concrete 30 as delivered from a feeding device such as a conveyor 32 which directs the concrete through funneling mouth 28 and into the jacket 18 above the extruder head assembly 12.

Referring now to FIG. 2, the extruder head assembly 12 is comprised of a troweling cylinder assembly 34 and a plurality of roller assemblies 36.

Troweling cylinder assembly 34 includes a circular head plate 38 fixedly anchored upon an annular ledge 40 projecting inwardly at the top of a downwardly extending cylindrical sidewall 42. As is well known, the sidewall 42 has a smooth outer troweling surface 44 for engaging and finishing the inside surface 46 of the concrete pipe 22 being formed. Welded centrally to the head plate 38 is an upstanding cylindrical hub 48 having a first circular flange 50 which is secured by bolts 52 to a mating second circular flange 54 joined to the bottom end of drive shaft 24. The hub 48 and flanges 50, 54 are suitably dimensioned so as to allow the extruder head assembly 12 to adequately handle the rotational and vertical forces applied through the drive shaft 24.

Roller assemblies 36 include a plurality of stepped rollers 56 eccentrically mounted for rotation upon the head plate 38 of troweling cylinder assembly 34. The rollers 56 are rotated by frictional contact with the concrete material 30 in a direction counter to the direction of rotation of drive shaft 24 and troweling cylinder assembly 34 connected thereto. In the preferred embodiment, a set of five rollers 56 is spaced about the periphery of head plate 38 for the general purposes of compacting the concrete delivered into jacket 18 as is well understood. Each roller 56 is integrally formed with an upper cylindrical segment 58, an intermediate cylindrical segment 60 and a lower cylindrical segment 62, each segment having a substantially similar height but a distinctly different diameter. In particular, upper segment 58 has a diameter which is smaller than the diameter of the intermediate segment 60 which, in turn, has a diameter which is smaller than the diameter of the lower segment 62. In some instances depending upon the specification of the concrete pipe required, it may be desirable to provide a roller 56 having at least two steps or more than three steps, it being understood that such modification falls within the purview of the invention. In each case, the outermost edge of the lower segment 62 is preferably in vertical alignment with the smooth outer troweling surface 44 of troweling cylinder sidewall 42. The effect of supplying increasingly larger diameters on the rollers 56 from top to bottom is to advantageously provide an increasing degree of concrete compaction as the extruder head assembly 12 is rotated and lifted in the jacket 18.

As seen in FIG. 3, each of the rollers 56 has a downwardly extending support shaft 64 which is rotatably mounted in a bore 66 formed in a cylindrical bearing unit 68 fixed to and depending from the head plate 38. The bearing unit 68 has an annular collar 70 having a top surface 72 upon which the roller 56 is rotatably supported. Each collar 70 has side and bottom portions 74, 76, respectively, which are received within a recess 78 formed in the head plate 38. Each collar 70 and recess 78 have a mating non-circular shape when viewed in plan, such that the bearing unit 68 will be prevented from rotating relative to head plate 38. When fixed in the recess 78 formed in the head plate 38, the collar 70 has a height which will keep the bottom of roller lower segment 62 slightly spaced from the top of the head plate 38 so that there is adequate clearance for the rollers 56 to rotate. Also included in the bearing unit 68 is a set of conventional ball bearings 80 which surround the support shaft 64 and allow each roller 56 to freely rotate relative to the head plate 38.

In accordance with the invention, each of the rollers 56 is interconnected together in a manner which will synchronize the rotation and speed of the rollers 56 and equalize frictional forces should any of the friction driven rollers 56 become stuck or jammed because of concrete or other particles becoming lodged between the bottom of the roller 56 and the top of the head plate 38.

To accomplish this, a tooth-engaging drive sprocket 82 having a depending cylindrical sleeve 83 is keyed to the bottom end of each support shaft 64 such that rotation of the drive sprocket 82 will turn the support shaft 64 and the roller 56 relative to its bearing unit 68. Drive sprockets 82 are positioned on support shafts 64 such that they all lie in the same horizontal plane. As shown in FIG. 4, five spaced idler sprockets 84 having depending cylindrical sleeves 85 are rotatably supported on shafts 86 which are fixed to and extend downwardly from the bottom of head plate 38, each idler sprocket 84 lying in the same horizontal plane as the drive sprockets 82. A linkage arrangement 90 interengages each of the drive sprockets 82 along an outer peripheral portion and idler sprockets 84 along an inner peripheral portion and over a winding path illustrated in FIG. 4. In the preferred embodiment, the linkage arrangement 90 takes the form of a chain, although it should be understood that a belt, gears or another suitable transmission arrangement could likewise be employed. Drive sprockets 82, idler sprockets 84 and linkage arrangement 90 define a synchronous friction drive for collectively driving the rollers 56 without sticking such that they will exceed simple compaction of the concrete. In other words, the rollers 56 with their particular stepped configuration can be jointly powered beyond the simple friction drive taking advantage of the large diameter on lower segment 62 of roller 56 to provide an extrusion process in which the concrete 30 is given an increasingly higher amount of compaction as the pipe 22 is formed.

Looking again at FIG. 2, a pair of upright fins or vanes 92 extend upwardly from a horizontal base plate 94 fixed to the top of each roller upper segment 58. The vanes 92 function to engage concrete 30 being delivered into jacket 18 and centrifugally sling the concrete 30 against the jacket 18. In order to prevent concrete 30 from falling downwardly around hub 48 and flanges 50, 54, a circular neck 96 is welded in tight surrounding relationship to the hub 48. The neck 96 supports a circular plate 98 which is secured thereto by bolts 100 and nuts 102. The plate 98 is formed inwardly with an aperture 104 having a diameter slightly larger than the diameter of the hub 48 so that the plate 98 will lie in offset relationship thereto. The plate 98 is formed outwardly with scalloped walls defining clearance recesses 106 to accommodate and partially surround the upper segments 58 of rollers 56.

When forming small diameter pipe, such as pipe having a twelve inch, fifteen inch or eighteen inch diameter, the size of rollers 56 prohibits mounting an effective fin, such as 92, to the upper surface of the roller. In such applications, fins 92 on rollers 56 are eliminated, and a separate hood is mounted to hub 48 and fins such as 92 are mounted to the hood. The hood is a disc-shaped circular member having an outside diameter roughly equal to the outside diameter of the circumcircle described by upper roller segments 58 upon rotation of drive shaft 24. The hood includes an opening through which hub 48 extends, and the hood is welded to hub 48. The vanes are in the form of a series of upstanding rectangular sections, the outer edge of which is located adjacent to, or substantially in alignment with, the outer edge of the hood. With this arrangement, the vanes function to force concrete outwardly upon rotation of drive shaft 24 and hub 48 prior to engagement of the concrete by rollers 56. The hood also functions to prevent concrete from entering the internal space between rollers 56 and hub 48.

In use, extruder head assembly 12 is first positioned in the bottom of jacket 18 adjacent pallet 16. Concrete 30 is then moved by conveyor 32 into funneling mouth 28 on the top table 26 and dropped onto extruder head assembly 12. Drive shaft 24 is then operated to rotate the head plate 38 and troweling cylinder assembly 34 in one direction. The friction driven rollers 56 are rotated in an opposite direction by engagement with concrete 30 to form the concrete pipe 22 adjacent the inside wall of jacket 18 as the extruder head assembly 12 moves up the mold chamber defined by the interior of jacket 18. Concrete 30 deposited on top of extruder head assembly 12 is slung by vanes 92 to the outside walls of jacket 18. Thereafter, the concrete is acted upon sequentially by the upper, intermediate and lower segments 58, 60, 62, respectively, of rollers 56 to increasingly compact and distribute the concrete 30 forcing it against the inside of jacket 18 and reducing its bulk. As the extruder head assembly 12 is further rotated and lifted, the concrete 30 is engaged by the smooth outer surface 44 on the troweling cylinder sidewall 42 to provide a smooth finish to the inside surface of concrete pipe 22.

In the event concrete or other invasive material becomes stuck or jammed in the clearance between the bottom of any roller 56 and the top of the head plate 38 so as to prevent rotation of any one of rollers 56, concrete compaction is then impaired and the consistency of the pipe formation is altered. To combat this problem, the linkage arrangement 90 coupling the rollers 56 together will act to override any such frictional resistance caused by the jammed material by distributing the frictional resistance forces to all of the roller assemblies 36, which functions to drive all of roller assemblies 36 simultaneously. The present invention thus provides a means for powering the rollers 56 beyond the normal friction drive without the necessity for a separate motorized drive system, thus simplifying the system in a cost effective manner. Together, the linkage arrangement 90 and the stepped roller configuration are particularly effective in extruding the concrete and providing a continuously high degree of compaction.

While the invention has been described with reference to rollers 56 having a stepped configuration, it is understood that straight sided rollers will be used in some applications, normally when forming small diameter pipe, wherein the frictional area is not large enough to require the advantages provided by use of a stepped roller.

The arrangement by which rollers 56 are drivingly engaged with each other is shown and described as a chain and sprocket arrangement, or a belt and gear arrangement. In some small diameter applications, there is insufficient space within the interior of troweling cylinder 34 to enable use of a system of this type. In such applications, the means by which the rollers are drivingly interconnected will be in the form of gears mounted to the lower ends of bearing units 68 and drivingly engaged with suitable idler gears for transmitting rotary power from one roller 56 to the other rollers 56 and to provide their synchronous rotation. While the exact construction of a gear-driven system is not illustrated, the layout and construction of such a system is well within the purview of one of ordinary skill in the art.

While the invention has been described with reference to a preferred embodiment, those skilled in the art will appreciate that certain substitutions, alterations and omissions may be made without departing from the spirit thereof. Accordingly, the foregoing description is meant to be exemplary only, and should not be deemed limitative on the scope of the invention set forth with following claims.

I claim:

1. In a concrete pipe manufacturing machine having a forming head assembly axially movable and rotatable about the longitudinal axis of a mold to which a concrete mixture is delivered, the forming head assembly including a plurality of friction driven rollers engageable with the concrete mixture, the improvement comprising:

a transmission arrangement coupling each of the rollers together and defining a synchronous friction drive for driving each of the rollers at the same speed and equalizing the frictional forces applied to the rollers, wherein the transmission arrangement is non-motorized.

2. The improvement of claim 1, wherein the transmission arrangement includes:

a set of drive sprockets, each drive sprocket being fixed for rotation on one of the rollers;

a set of idler sprockets, each idler sprocket being rotatably mounted on the forming head assembly and lying in the same horizontal plane as the drive sprockets; and a chain linking the drive sprockets and the idler sprockets together.

3. The improvement of claim 2, wherein the chain is wound about an outer peripheral portion of the drive sprockets and an inner peripheral portion of the idler sprockets.

* * * * *